US009470242B2

(12) United States Patent
Albert et al.

(10) Patent No.: US 9,470,242 B2
(45) Date of Patent: Oct. 18, 2016

(54) PUMP

(71) Applicant: E.G.O. Elektro-Geraetebau GmbH, Oberderdingen (DE)

(72) Inventors: Tobias Albert, Kraichtal (DE); Uwe Koegel, Kuernbach (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 669 days.

(21) Appl. No.: 13/924,212

(22) Filed: Jun. 21, 2013

(65) Prior Publication Data

US 2013/0343882 A1 Dec. 26, 2013

(30) Foreign Application Priority Data

Jun. 22, 2012 (DE) ..... 10 2012 210 554

(51) Int. Cl.

| | |
|---|---|
| ***F03B 11/02*** | (2006.01) |
| ***F04D 29/44*** | (2006.01) |
| ***F04D 29/58*** | (2006.01) |
| ***A47L 15/42*** | (2006.01) |
| ***D06F 39/08*** | (2006.01) |

(52) U.S. Cl.

CPC ..... *F04D 29/445* (2013.01); *A47L 15/4225* (2013.01); *D06F 39/085* (2013.01); *F04D 29/588* (2013.01)

(58) Field of Classification Search

CPC ..... A47L 15/4225; D06F 39/085; F04D 29/445; F04D 29/588

See application file for complete search history.

(56) References Cited

U.S. PATENT DOCUMENTS

| | | | | |
|---|---|---|---|---|
| 6,736,598 | B2 | 5/2004 | Kleemann et al. | |
| 7,100,623 | B2 * | 9/2006 | Assmann | A47L 15/4221 134/184 |
| 8,245,718 | B2 | 8/2012 | Büsing et al. | |
| 8,317,422 | B2 | 11/2012 | Schell | |
| 8,899,918 | B2 * | 12/2014 | Weber | F04D 9/003 415/206 |
| 2004/0173249 | A1 | 9/2004 | Assmann et al. | |
| 2010/0126534 | A1 | 5/2010 | Büsing et al. | |

FOREIGN PATENT DOCUMENTS

| | | | |
|---|---|---|---|
| DE | 20018182 | U1 | 12/2001 |
| DE | 10142525 | A1 | 3/2003 |
| DE | 10145353 | A1 | 4/2003 |

(Continued)

OTHER PUBLICATIONS

European Patent Office, Extended European Search Report for Application No. 13171905.6, 7 pages, Mar. 20, 2015, 7 pages, Germany.

(Continued)

*Primary Examiner* — Craig Kim
*Assistant Examiner* — Jason Fountain
(74) *Attorney, Agent, or Firm* — Alston & Bird LLP

(57) ABSTRACT

An impeller radial pump includes a pump chamber with a central suction and with a pump chamber outlet, wherein an impeller is provided in the pump chamber. Radially outside of the impeller, a circular ring shaped and circumferential pump chamber ring section is provided as a part of the pump chamber, wherein the pump chamber ring section essentially has an extension along the axial direction of the pump from the impeller against the suction direction. The pump chamber ring section has a varying width and is configured to be narrower in a compression region in the circulation direction.

15 Claims, 3 Drawing Sheets

(56) References Cited

FOREIGN PATENT DOCUMENTS

| | | | |
|---|---|---|---|
| DE | 102007017271 | A1 | 10/2008 |
| EP | 1247993 | A2 | 10/2002 |
| EP | 2150162 | A2 | 2/2010 |
| EP | 2150165 | B1 | 10/2012 |
| JP | 10184581 | A | 7/1998 |
| JP | 2005-240766 | A | 9/2005 |
| WO | WO 03/005875 | A1 | 1/2003 |
| WO | WO 2006/027331 | A1 | 3/2006 |

OTHER PUBLICATIONS

German Patent and Trade Mark Office, Office Action for Application No. 102012210554.9, Jan. 14, 2013, 5 pages, Germany.

* cited by examiner

PUMP

CROSS-REFERENCE TO RELATED APPLICATIONS

This application claims priority to German Application No. 10 2012 210 554.9, filed Jun. 22, 2012, the contents of which are hereby incorporated herein in its entirety by reference.

TECHNOLOGICAL FIELD

The invention relates to a pump as can well be used in particular for home appliances such as dish washers or washing machines, wherein the pump is configured as a radial pump.

BACKGROUND

Such radial pumps are known for example from U.S. Pat. No. 8,245,718 B. They comprise a pump chamber with a central suction pipe and a pump chamber outlet, wherein an impeller rotates in the pump chamber in order to transport fluid from the suction pipe in the radial direction out of the impeller into the pump chamber and after several circulations in the pump chamber out of the same via the pump chamber outlet. Outside the impeller or in the fluid path, so to say downstream of the impeller, in the pump chamber an essentially circular ring shaped pump chamber ring section is provided, which section extends in the axial direction of the pump, namely away from the impeller opposite to the direction of the suction pipe into the pump, i.e. towards the pump chamber outlet.

In particular when starting a pumping procedure after a longer period of time, air can accumulate in the pump chamber, in particular on a pump chamber bottom close to the impeller. During the start of the pumping procedure, said air interferes with the efficiency of the pump. In order to now discharge the air more quickly, it was proposed to arrange guide elements with blades or the like in the pump chamber, in particular close to the impeller. This is also shown, for example, by the aforementioned EP 2150165 B. However, said guide elements involve an additional constructional effort or effort in terms of components, respectively.

BRIEF SUMMARY

The object underlying the invention is to provide an abovementioned pump by means of which problems of the prior art can be solved, and in particular a pump can be provided that performs efficiently and most important that can discharge air present in the pump chamber during the start of the pumping procedure.

Said object is achieved by means of a pump. Advantageous as well as preferred embodiments of the invention are contained in the further claims and will be described in more detail in the following. The wording of the claims is incorporated into the content of the description by explicit reference.

The pump comprises a pump chamber with central suction and with a pump chamber outlet, wherein in the pump chamber an impeller rotates for transporting fluid or for discharging the fluid from the suction in radial direction out of the impeller into the pump chamber. The discharged fluid is moved for circulation in the pump chamber towards the pump chamber outlet, wherein said fluid also flows in axial direction of the pump from the impeller against the suction direction towards the outlet. Radially outside the impeller, a circular ring shaped and circumferential pump chamber ring section is provided as a part of the pump chamber, wherein the pump chamber ring section essentially has an extension along the axial direction of the pump.

In said pump, it is provided according to the invention that the pump chamber ring section has a varying width in the circulation direction and is configured to be narrower in a compression region. In this case, a narrow width, in particular in the radial direction, can be at least 20% or 30% of the maximum width. However, in particular said minor width is less than 70%.

By means of said narrow configuration of the pump chamber ring section, the pressure in the transported fluid can be altered or increased, respectively, and the circulation rate of the fluid can be increased for an improved transporting. In particular, air accumulated in the pump chamber can be better removed or transported away by means of said pressure increase. Furthermore, the maximum air volume in the pump chamber is reduced since there is less space available, what also helps for that purpose.

In one embodiment of the invention it is provided that the pump chamber ring section becomes gradually or continuously narrower in the circulation direction of the fluid transported towards the compression region, so that then a small width present along the circulation direction is essentially constant over a certain length of the compression region. That can be at least 20% to 30% of the circumference, preferably up to 40% or 50%. Advantageously, downstream thereof, the width increases again in the circulation direction, wherein that can be slower and over an even greater length than towards the compression region.

In an advantageous embodiment of the invention it is provided that along the axial direction of the pump the radial width of the pump chamber ring section remains essentially the same over at least half of the axial length of the pump chamber ring section or of the pump chamber per se, preferably slightly more than two thirds thereof. Preferably, said region is located close to the pump chamber outlet or extends up to said outlet. In the direction towards the impeller, the pump chamber ring section can also be configured slightly more widened, in particular as a transition to the rest of the pump chamber in the region of the impeller per se.

In a further embodiment of the invention, it can be provided that the pump chamber tapers monotonously in terms of its width in radial direction, that is quasi relative to its cross sectional area, outside the impeller in axial direction away from the pump chamber bottom. Said tapering is advantageously strictly monotonously. Not before the outlet there is a widening, however here in the circumferential direction. By means of said tapering of the cross section of the pump chamber or of the pump chamber ring section, the pressure conditions can be configured in an advantageous manner for a good transporting and thus a good heating of transported fluid or water, respectively. Furthermore, here the transport rate of the fluid can be increased for an adaption in terms of the heat absorption of the heating device, since the fluid becomes increasingly hotter while circulating in the pump chamber.

In yet another embodiment of the invention, a heating device can be integrated into the pump in order to heat the fluid transported by means of the pump. Advantageously it can be provided that an external pump chamber wall is heated as an exterior wall of the pump chamber ring section, partly also of the rest of the pump chamber, or that said wall is a part of a heating device or formed by means of the same.

In a particularly advantageous configuration, said pump chamber wall then covers at least 75%, advantageously at least 90% or even essentially the entire axial length of the pump chamber ring section or of the pump chamber, respectively. Such a heating device can then be configured essentially round-cylindrical or as a tube section, that is to say continuous and advantageously seamless also in the circumferential direction.

In particular in the case of a heated pump or a pump with integrated heating device, by means of the partially minor pump chamber ring section and the resulting increase of the velocity of the transported fluid, a greater heating power can be introduced in the fluid or the absorption of heat from the heating device can be improved, respectively.

In the invention, it is provided that the pump chamber or the entire pump is configured without a guide ring or has no guide elements in the type of a guide ring or the like. Such guide elements are those elements or components that protrude from other walls in the pump chamber and extend into the fluid path for special directing or deflecting of the transported fluid. As a result, the construction of the pump can be simplified. By means of the above described effect of the minor pump chamber ring section, it could be proved in tests that the efficiency of the pump can be improved even without guide elements.

In a further embodiment of the invention, it is advantageously provided to configure a lower cover plate of the impeller in such a curved manner that it is curved radially inwards towards an aforementioned suction port that forms the suction, that is to say curved in axial direction away from the pump chamber bottom. Advantageously, the lower cover plate of the impeller is curved in the same axial direction radially outwards. Said curvature can be less pronounced than that radially inwards, but nevertheless can be clearly present. The impeller rotates above said pump chamber bottom in the pump chamber, wherein advantageously the pump chamber bottom is also curved radially outside the impeller with a continuation of the curvature of the lower cover plate of the impeller in the radial outer region. In particular, the curvature is continuous and uniform as viewed in a side sectional view of the impeller and continues essentially continuously and in a uniform manner in the pump chamber bottom. For that purpose, the impeller or its lower cover plate can be slightly inserted into the pump chamber bottom. Then, the pump chamber bottom extends with a certain curvature close to the pump chamber ring section or even up to said section and thus directs the fluid discharged out of the impeller in an oblique angle against the heated pump chamber ring section for heating.

Said region of the minimum width or cross sectional area of the pump chamber ring section is advantageously in a region of the pump chamber or of the pump shortly behind the location where the outlet leads out of the pump chamber housing. The outlet out of the pump chamber namely leads outwards advantageously in the region of the greatest width or the greatest cross-sectional area, that means that the integrally shaped outlet in said region moves out of and is shaped out of the shape present for the rest of the pump chamber.

In the invention it is provided that the axial length of the pump chamber ring section is the multiple of the width of the pump chamber ring section, namely four times to ten times of said width, preferably of the maximum width of the pump chamber ring section. Preferably said length is about five to seven times the width of the pump chamber ring section, namely the maximum width of the pump chamber ring section.

Said features and further features arise besides from the claims also from the description and the drawings, wherein in each case the individual features can be realized on their own or in the form of sub-combinations thereof in an embodiment of the invention and in other fields and represent advantageous as well as protectable embodiments per se, for which protection is claimed hereby. The division of the application into individual sections as well as cross-headings does not limit the general validity of the statements made therein.

BRIEF DESCRIPTION OF THE SEVERAL VIEWS OF THE DRAWINGS

Exemplary embodiments of the invention are schematically shown in the drawings and will be explained in more detail in the following. The drawings show in.

DETAILED DESCRIPTION

Figure 1:
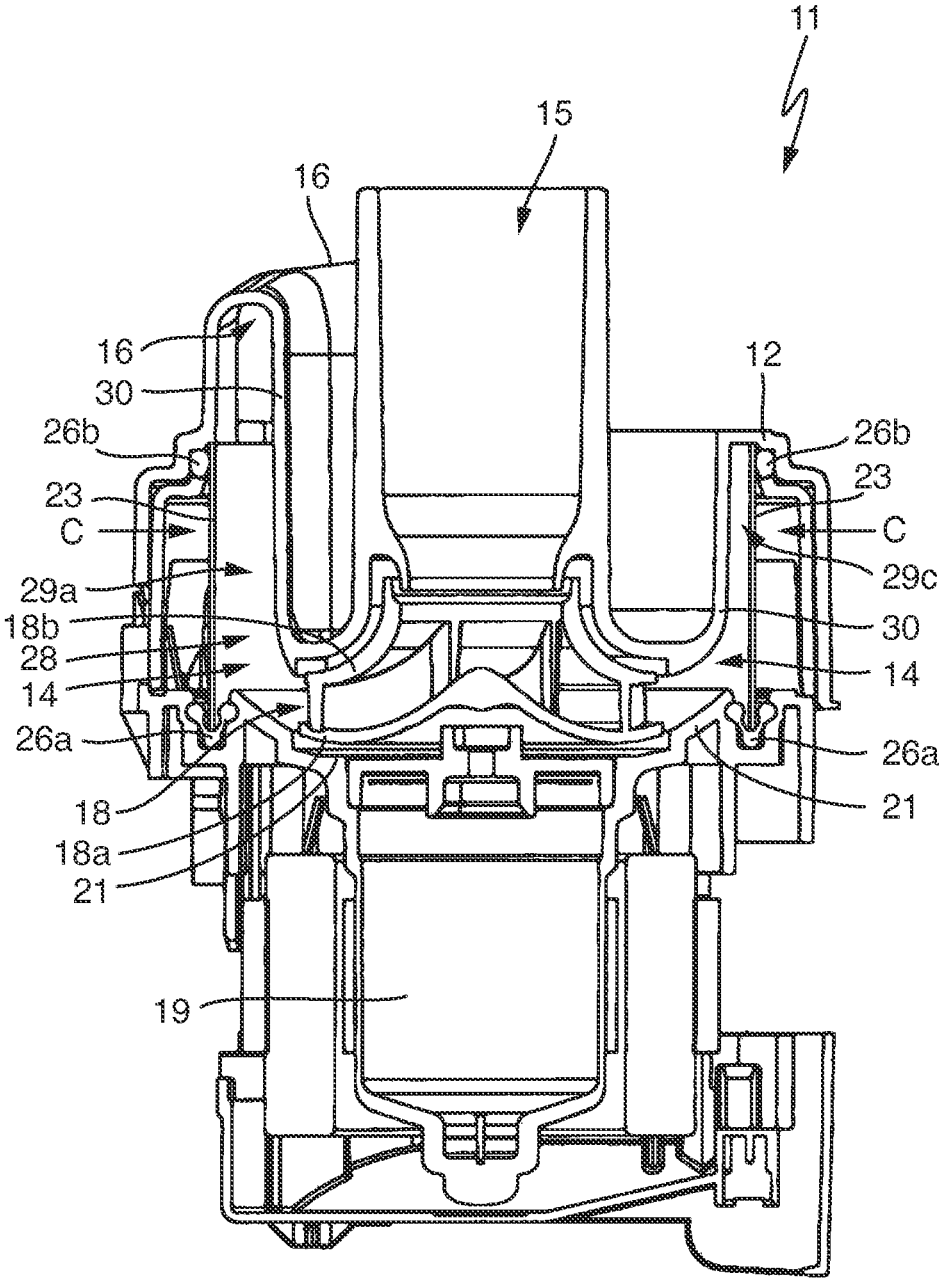
FIG. 1 sectional longitudinal view of a pump according to the invention.

In FIG. 1 a pump 11 with a pump housing 12 is shown as generally known from the aforementioned prior art. The pump housing 12 comprises a pump chamber 14 and a central axial suction pipe 15 leads into said chamber and an outlet 16 leads out of said chamber in the tangential direction. The suction pipe 15 leads exactly towards a centrally arranged impeller 18 with a lower cover plate 18*a* and an upper cover plate 18*b*. The impeller 18 is driven by a pump motor 19 and extends above a pump chamber bottom 21 having a step-like, central depression adapted to the lower cover plate 18*a*.

The radially exterior wall of the pump chamber 14 is formed by a tubular heating device 23 as for example known from U.S. Pat. No. 8,245,718 B, namely as a metallic tube having a constant diameter with the ends cut off in a straight manner. On the exterior side of the tube, heating elements not shown are provided for the heating device 23, advantageously thick-film heating elements.

The heating device 23 is supported in the lower region in a V-sealing 26*a* for sealing purposes, wherein the V-sealing 26*a* extends circumferentially radially outside the pump chamber bottom 21 and close to the latter. At the upper end of the pump chamber 14, i.e. axially away from the impeller 18, a sealing ring 26*b* having a round cross-section is provided externally on the heating device 23. As a result, the heating device 23 is in each case sealed outwards against the pump housing 12 and inwards forms the external wall of the pump chamber 14. As can be seen from FIG. 4, the heating device 23 is circular or has a circular cross-section.

The pump chamber 14 comprises radially outside of the impeller 18 a transition region at approximately the same axial height, which region merges into a pump chamber ring section 28. The pump chamber ring section 28 is defined to be essentially the region where the pump chamber 14 has approximately the same width 29 in radial direction, which width does not change in axial direction or which can also decrease. Thus, while the exterior wall also of the pump chamber ring section 28 is formed by the heating device 23, the internal wall is formed by an inner wall 30 of the pump housing 12. It can be seen that on both sides in axial direction slightly above the fluid outlet from the impeller 18, said inner wall 30 and the heating device 23 extend at an approximately constant distance to one another, i.e. the pump chamber ring section 28 having an approximately constant width or even a decreasing width in the axial direction.

Figure 4:
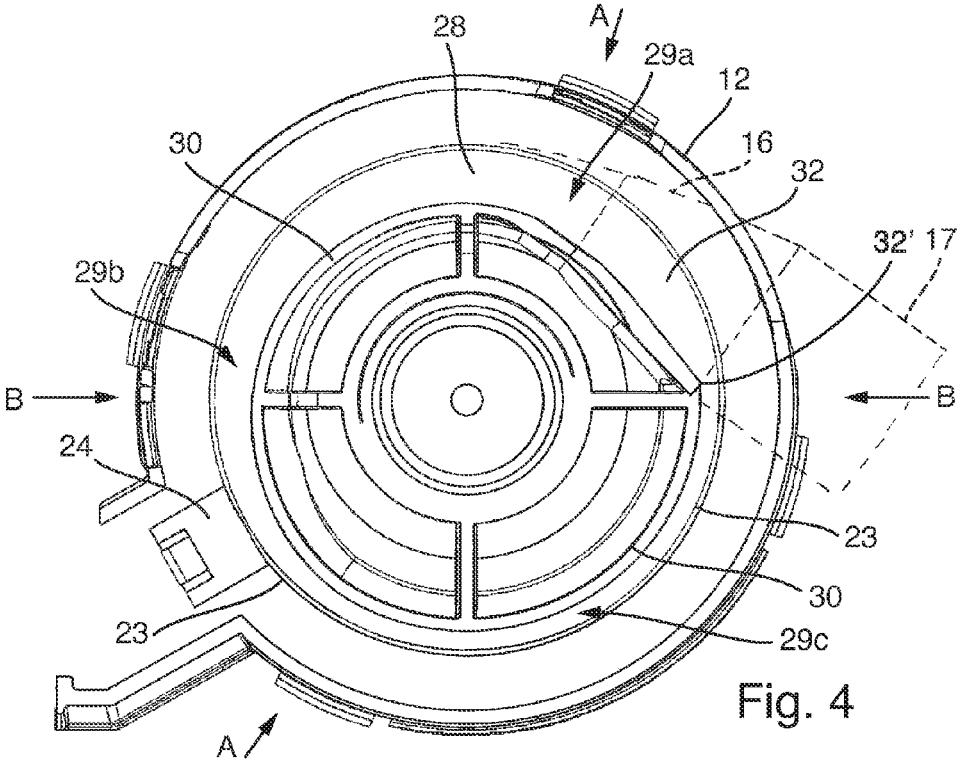

Then, in the axial direction, the pump chamber ring section 28 has in each case an approximately constant width or the same cross-section or even a decreasing width, wherein the width 29 actually varies in the circulation direction, as can be seen from the sectional view in FIG. 4. In FIG. 1, a section through a pump 11 is shown, where at the top a width 29*a* of the pump chamber ring section 28 is approximately the greatest, while on the right below a width 29*c* is approximately minimal. The sectional view according to C-C of FIG. 4 shows that, wherein in this case, the sectional longitudinal view of FIG. 1 is illustrated as a section A-A.

Figure 2:
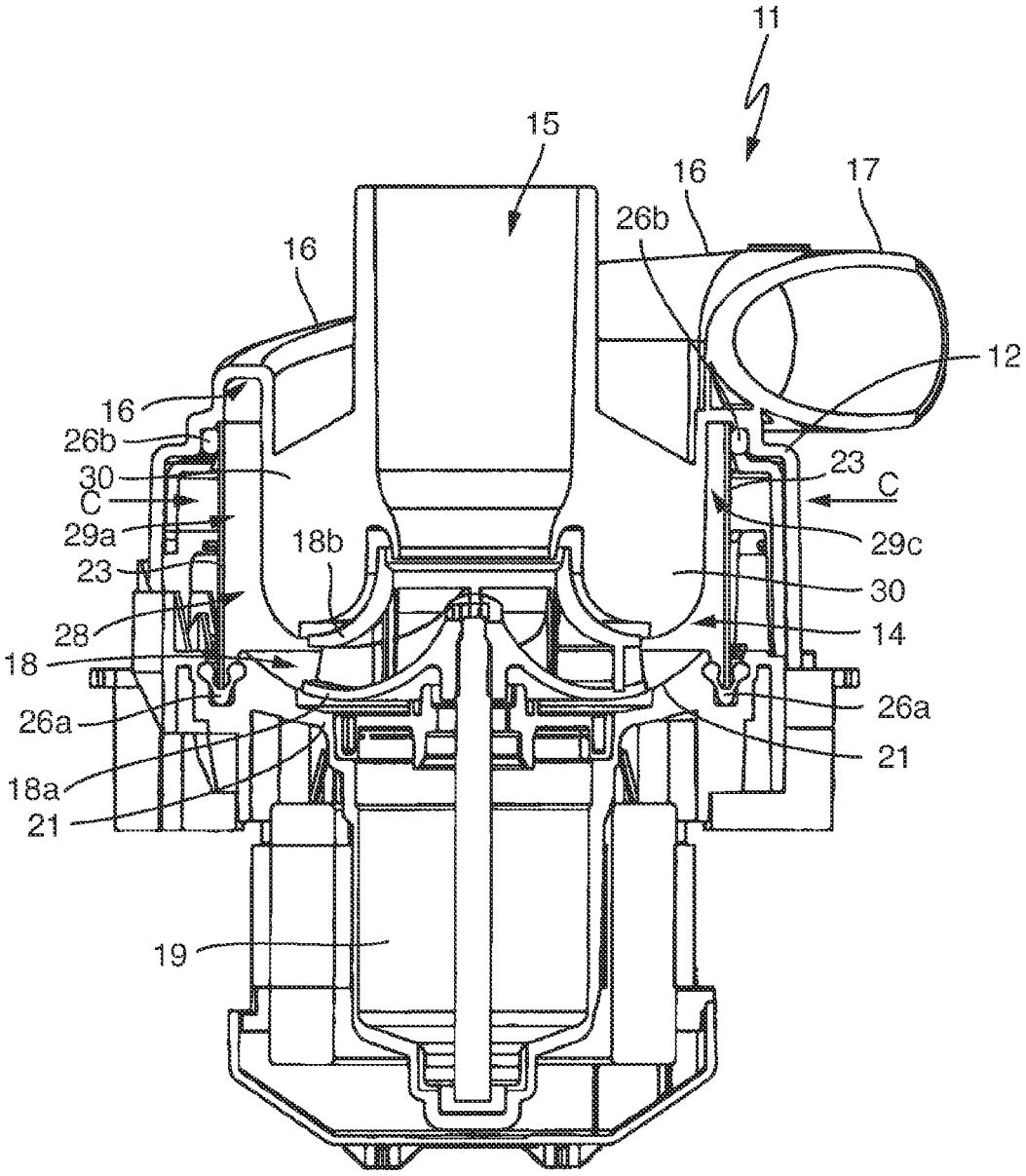
FIG. 2 sectional longitudinal view of the pump of FIG. 1 turned by about 70°, FIG. 3 plane view of the pump from above, and FIG. 4 sectional transverse view of the pump showing the course of the width of a pump chamber ring section in circulation direction.

With respect to FIG. 2, it is noted that in the sectional plane view of FIG. 4 according to the section B-B, FIG. 2 shows a region, where indeed on the right side again a minimum width 29*c* is present at the pump chamber ring section 28. In contrast, on the left side a moderate width 29*b* is present, which is also illustrated in FIG. 4.

It can also be seen that the axial length of the pump chamber ring section 28 is about seven or eight times the maximum width 29*a* of this section. Also the outlet 16 is much higher above the impeller.

Figure 3:
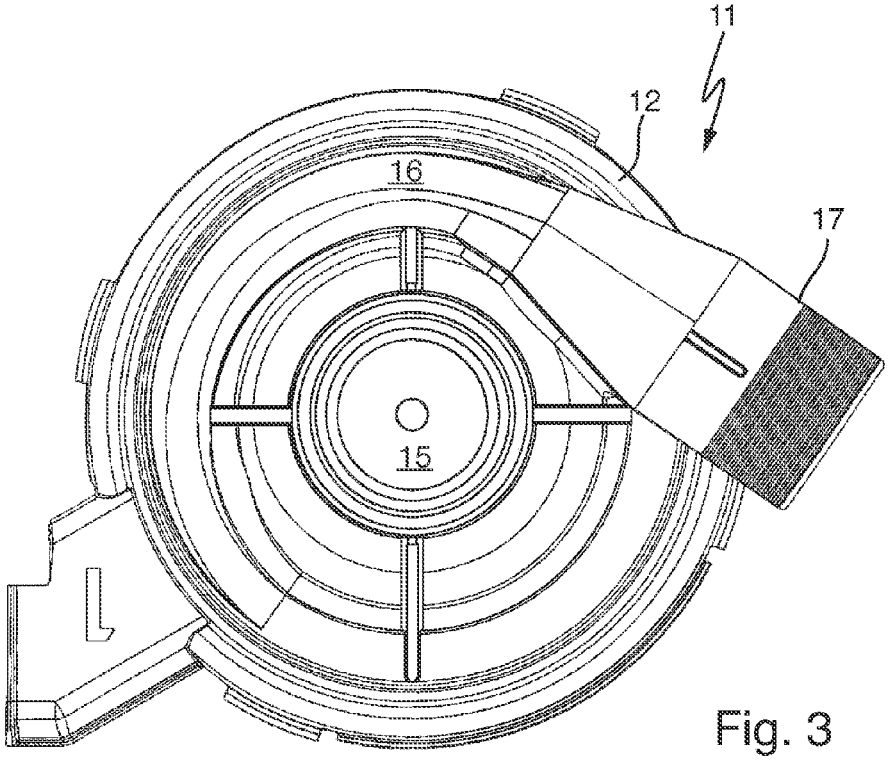

FIG. 3 shows a plane view of the pump 11 with the pump housing 12 including suction pipe 15 and outlet 16, which merges into an outlet port 17. However, of more interest is FIG. 4 according to the section C-C of FIG. 1 illustrated directly below FIG. 3, wherein here outlet 16 and outlet port 17 are illustrated in dashed lines. It can be seen that coaxially to the suction pipe 15 the heating device 23 extends as exterior wall of the pump chamber 14. However, the width 29 of the pump chamber ring section 28 is determined by means of the differently extending inner wall 30. Approximately shown are the width 29*a*, which is approximately maximum, the moderate width 29*b* and the smallest or narrow width 29*c*. Said narrow width 29*c* extends over an arcuate angle of approximately 120° almost up to an electric connection plug 24, which is arranged externally on the heating device 23. From there, the width 29 of the pump chamber ring section 28 increases again in a continuous manner over the moderate width 29*b* up to the maximum width 29*a*. Said maximum width 29*a* is present approximately at the location where the outlet 16 with the tubularly configured outlet port 17 is separated from the pump chamber 14 or the pump chamber ring section 28 per se, i.e. approximately at the illustrated section A-A. As from said region, the width 29 tapers again with a tapering 32 up to the tapering end 32', where then in turn the smallest or narrow width 29*c* starts. The tapering 32 extends over a region of approximately 70°.

It can clearly be seen that externally, the width 29 of the pump chamber ring section 28 is determined by the circular ring shaped heating device 23 and internally, by the inner wall 30.

From the plane view in FIG. 4, it can also be seen that actually the region of the pump chamber ring section 28 having the smallest width 29*c* is the only region having a constant width. In the region adjacent thereto in the circulation direction corresponding to the clockwise direction, the width increased essentially in a uniform manner in order to then significantly decrease again in the region of the tapering 32. It can also be seen that approximately the factor 3 applies to the difference between the maximum width 29*a* and the minimum width 29*c*.

However, at the same time it is also conceivable that the inner wall 30 of the pump chamber 14 or of the pump chamber ring section 28 is circular or concentric relative to the rotation axis of the impeller 18 or to the central longitudinal axis of the suction 15. Then, the externally surrounding exterior wall, in particular also in the form of a heating device, is non-concentric such that so to say it is offset relative to the same or configured in a non-round manner, respectively. As a further alternative, also both walls could be non-concentric to one another or to the central longitudinal axis of the pump.

By means of the narrowed flow cross-section of the fluid circulating in the clockwise direction in FIG. 4 in the region of the smallest width 29*c* of the pump chamber ring section 28, the fluid velocity is significantly increased. Inter alia, that supports a de-aeration of the pump 11 in case there are air bubbles present in the region of the pump chamber bottom 21, regardless of the reason. By means of the enlargement of the width 29 from the minor region 29*c* via the moderate width 29*b* to the greatest width 29*a*, the velocity of the fluid is reduced. By means of both the change in the velocity of the circulating fluid which, for example, circulates approximately three to eight times from the discharge out of the impeller 18 into the pump chamber 14 up to the discharge out of the outlet 16 or the outlet port 17, and the significantly higher velocity in the minor region, trapped air or an air/fluid mixture can be transported out of the pump 11 in an improved manner. For that purpose, otherwise guide rings or similar guide structures were provided and required, as for example known from EP 2150162 B. However, the production thereof as well as the installation are relatively elaborate and can result in problems as well as breakdowns and thus errors in the pump. Furthermore, the heat transfer in the invention from the heating device to the fluid or water is increased due to the increased flow rate of the fluid.

It proved to be advantageous, however not mandatory, for the aforementioned effects of improving the de-aeration as well as improving the heating, when, as shown in FIGS. 1 and 2, the pump chamber ring section 28 has the same width or even a decreasing width over a certain axial length of said section. However, at the same time it is to be considered that the increased width of the pump chamber ring section 28 is also present in the region radially outside the impeller 18 and at the axial height thereof. Particularly by means of that, the improved de-aeration is supposed to be achieved.

That which is claimed:

1. A pump, in particular for home appliances such as dish washers or washing machines, said pump being configured as a radial pump, comprising:

a pump chamber with a central suction and with a pump chamber outlet, wherein:

in said pump chamber an impeller rotates for transporting fluid and for discharging said fluid from said suction in a radial direction out of said impeller into said pump chamber;

said discharged fluid is moved for circulation in said pump chamber towards said pump chamber outlet;

radially outside said impeller, a circular ring shaped and circumferential pump chamber ring section is provided as a part of said pump chamber;

said pump chamber ring section essentially comprises a length along an axial direction of said pump from said impeller against a suction direction up to said pump chamber outlet;

said axial length of said pump chamber ring section is four times to ten times its width;

said pump chamber ring section comprises a varying width and is configured to be narrower in a compression region in a circulation direction;

said pump chamber is configured without a guide ring for said fluid and does not have guide elements of a type of said guide ring; and said pump chamber ring section is gradually or continuously narrower in said circulation direction towards said compression region.

2. The pump according to claim 1, wherein said pump chamber ring section is to be gradually or continuously narrower to a constant small width of said compression region present along said circulation direction over a certain length in said circulation direction towards said compression region.

3. The pump according to claim 2, wherein said pump chamber ring section widens again downstream of said compression region in said circulation direction.

4. The pump according to claim 1, wherein a width in said compression region is at least 20% of a maximum width of said pump chamber ring section.

5. The pump according to claim 1, wherein said pump chamber ring section has a constant small width over at least 20% to 50% of a length of one circulation.

6. The pump according to claim 1, wherein in said axial direction of said pump, said width or said cross-section of said pump chamber ring section, respectively, largely remains the same in said region of said pump chamber ring section remote from said impeller in said axial direction.

7. The pump according to claim 6, wherein in said axial direction of said pump, said width or said cross-section of said pump chamber ring section largely remains the same in said region of said pump chamber ring section remote from said impeller in said axial direction close to said pump chamber outlet.

8. The pump according to claim 1, wherein said pump chamber tapers monotonously in said radial direction outside said impeller.

9. The pump according to claim 1, wherein said pump comprises an integrated heating device for heating said transported fluid.

10. The pump according to claim 9, wherein an exterior pump chamber wall is heated as exterior wall of said pump chamber ring section.

11. The pump according to claim 9, wherein an exterior pump chamber wall is a part of said heating device.

12. The pump according to claim 10, wherein said pump chamber wall covers an entire axial length of said pump chamber ring section.

13. The pump according to claim 1, wherein a lower cover plate of said impeller is curved such that radially towards an inside, it is curved towards a suction port forming said suction, wherein said pump chamber comprises a pump chamber bottom above which said impeller rotates, wherein said pump chamber bottom is curved radially outside said impeller, with an extension approximately corresponding to a curvature of said lower cover plate and merges into an exterior wall of said pump chamber or of said pump chamber ring section adjacent thereto.

14. The pump according to claim 13, wherein said lower cover plate of said impeller is curved radially to an outside in said same axial direction as radially towards said inside.

15. A pump, in particular for home appliances such as dish washers or washing machines, said pump being configured as a radial pump, comprising:

a pump chamber with a central suction and with a pump chamber outlet, wherein:

in said pump chamber an impeller rotates for transporting fluid and for discharging said fluid from said suction in a radial direction out of said impeller into said pump chamber;

said discharged fluid is moved for circulation in said pump chamber towards said pump chamber outlet;

radially outside said impeller, a circular ring shaped and circumferential pump chamber ring section is provided as a part of said pump chamber;

said pump chamber ring section essentially comprises a length along an axial direction of said pump from said impeller against a suction direction up to said pump chamber outlet;

said axial length of said pump chamber ring section is four times to ten times its width;

said pump chamber ring section comprises a varying width and is configured to be narrower in a compression region in a circulation direction;

said pump chamber is configured without a guide ring for said fluid and does not have guide elements of a type of said guide ring; and said increase of said width of said pump chamber ring section in said circulation direction away from said compression region is less or slower than a decrease of a width in said circulation direction towards said compression region.

* * * * *